US011754292B2

(12) United States Patent
Mori et al.

(10) Patent No.: US 11,754,292 B2
(45) Date of Patent: Sep. 12, 2023

(54) HEATING COOKER AND HEATING COOKING METHOD

(71) Applicant: Samsung Electronics Co., Ltd., Suwon-si (KR)

(72) Inventors: Aiko Mori, Yokohama (JP); Ritsuya Yamamoto, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 335 days.

(21) Appl. No.: 17/168,678

(22) Filed: Feb. 5, 2021

(65) Prior Publication Data

US 2021/0254835 A1 Aug. 19, 2021

(30) Foreign Application Priority Data

Feb. 14, 2020 (JP) ..... 2020-023245
Jan. 18, 2021 (KR) ..... 10-2021-0006591

(51) Int. Cl.

| | |
|---|---|
| ***F24C 7/08*** | (2006.01) |
| ***H05B 6/68*** | (2006.01) |
| ***F24C 15/00*** | (2006.01) |
| ***F24C 7/02*** | (2006.01) |

(52) U.S. Cl.

CPC ..... *F24C 7/087* (2013.01); *F24C 7/02* (2013.01); *F24C 15/003* (2013.01); *H05B 6/687* (2013.01)

(58) Field of Classification Search

CPC .. F24C 15/003; F24C 7/08; F24C 7/02; F24C 7/087; H05B 6/687

See application file for complete search history.

(56) References Cited

U.S. PATENT DOCUMENTS

| | | | | |
|---|---|---|---|---|
| 5,360,965 | A | 11/1994 | Ishii et al. | |
| 2016/0327281 | A1* | 11/2016 | Bhogal | H05B 1/0263 |
| 2017/0223774 | A1* | 8/2017 | Cheng | F24C 15/22 |
| 2018/0139805 | A1 | 5/2018 | Hayashi | |
| 2020/0019861 | A1 | 1/2020 | Jeong | |

FOREIGN PATENT DOCUMENTS

| | | | | |
|---|---|---|---|---|
| JP | 10-238785 | A | | 9/1998 |
| JP | 2000-3376369 | A | | 12/2000 |
| JP | 2007-218545 | A | | 8/2007 |
| JP | 2007218545 | A | * | 8/2007 |
| JP | 2011-19604 | A | | 2/2011 |
| JP | 2013-036635 | A | | 2/2013 |
| JP | 2018-138862 | A | | 9/2018 |
| JP | 2019-190682 | A | | 10/2019 |
| WO | 2017/178346 | A1 | | 10/2017 |
| WO | 2019/066216 | A1 | | 4/2019 |

OTHER PUBLICATIONS

International Search Report dated Jun. 4, 2021, issued in International Patent Application No. PCT/KR2021/001818.

* cited by examiner

*Primary Examiner* — Thien S Tran
(74) *Attorney, Agent, or Firm* — Jefferson IP Law, LLP

(57) ABSTRACT

A heating cooker that adjusts cooking operations according to detected cooking states of a food ingredient, and a method thereof are disclosed. The heating cooker includes a heater that heats an inside of a heating chamber in which a food ingredient is placed, and at least one processor that controls the heater to perform a protein denaturation operation, in which a rate of internal temperature rise of the food ingredient is equal to or greater than a reference rate, based on the internal temperature of the food ingredient in a range of from a first reference temperature to a second reference temperature.

18 Claims, 8 Drawing Sheets

HEATING COOKER AND HEATING COOKING METHOD

CROSS-REFERENCE TO RELATED APPLICATION(S)

This application is based on and claims priority under 35 U.S.C. § 119 of a Japanese patent application number 2020-023245, filed on Feb. 14, 2020, in the Japan Patent Office, and of a Korean patent application number 10-2021-0006591, filed on Jan. 18, 2021, in the Korean Intellectual Property Office, the disclosure of each of which is incorporated by reference herein in its entirety.

BACKGROUND

1. Field

The disclosure relates to a heating cooking technology. More particularly, the disclosure relates to a heating cooker that adjusts cooking operations according to detected cooking states of a food ingredient, and a method thereof.

2. Description of Related Art

In a conventional heating cooker, because means configured to sense a cooking state of food ingredient is insufficient, a user relies on checking with the naked eye or confirmation work in various cooking situations. In addition, as a technique of heating food ingredient, the research and development on the high-efficiency heating have been carried out and a technique of performing sequence control about a temperature inside a heating chamber, in which a food ingredient is placed, have been proposed.

A heating cooker disclosed in Japanese Unexamined Patent Application Publication No. 2013-36635 is provided with a heating chamber in which an object to be heated, which includes food and a container, is placed, a high frequency generator configured to generate a high-frequency for heating the object to be heated, an infrared array sensor configured to detect a temperature of a plurality of locations in a viewing angle including the object to be heated, and a controller configured to control a temperature of the object to be heated by controlling the high frequency generator. The controller receives a result of temperature detection about the plurality of locations from the infrared array sensor. The controller identifies a location indicating a temperature of food among the temperature of the plurality of locations based on the changed in the temperature of the plurality of locations generated by a first stage heating (preliminary heating) applied to the object to be heated, and based on the result of the identification, the controller controls a second stage heating (main heating) applied to the object to be heated.

The above information is presented as background information only to assist with an understanding of the disclosure. No determination has been made, and no assertion is made, as to whether any of the above might be applicable as prior art with regard to the disclosure.

SUMMARY

However, in the conventional heating cooker configured to perform the sequence control about the temperature of the heating chamber, the taste of the food is often poor in comparison a method of using a frying pan as well as it is difficult to sufficiently bring out the flavor(s), textures, and/or colors that indicate moderately baked food, and juiciness of the food ingredient.

In addition, in the case of cooking using the conventional heating cooker, it is difficult to simultaneously cook the outside and the inside of the food ingredient, and thus a user is often required to turn over the food ingredient during cooking, which makes the user's work complicated.

In addition, in the heating cooker of patent document 1, when a low-heating operation, in which a food ingredient is cooked at a relatively low temperature, is continued, it takes a long time to sufficiently increase an internal temperature of the food ingredient and thus there is a risk that a surface of the food ingredient becomes too dry. On the other hand, when a high-heating operation, in which a food ingredient is cooked at a relatively high temperature, is continued, there is risk that a surface of the food ingredient is burned or the food ingredient becomes stiff due to a rapid increase in the temperature of the food ingredient. Accordingly, even when using the heating cooker disclosed in patent document 1, it is difficult to make a delicious meal with the food ingredient.

Aspects of the disclosure are to address at least the above-mentioned problems and/or disadvantages and to provide at least the advantages described below. Accordingly, an aspect of the disclosure to provide a heating cooking technology capable of bring out flavor of food ingredients without complicating a user's work.

Additional aspects will be set forth in part in the description which follows and, in part, will be apparent from the description, or may be learned by practice of the presented embodiments.

In accordance with an aspect of the disclosure, a heating cooker is provided. The heating cooker includes a main body including a heating chamber in which a food ingredient is disposed, a heater configured to heat an inside of the heating chamber, a temperature detector configured to detect an internal temperature of the food ingredient, and at least one processor configured to control the heater based on the detected internal temperature of the food ingredient, and control the heater to perform a protein denaturation operation, in which a rate of internal temperature rise of the food ingredient is equal to or greater than a reference rate, based on the internal temperature of the food ingredient in a range of from a first reference temperature to a second reference temperature.

In accordance with another aspect of the disclosure, a method of using a heating cooker comprising a main body including a heating chamber in which a food ingredient is disposed, a heater configured to heat an inside of the heating chamber, and a temperature detector configured to detect an internal temperature of the food ingredient, is provided. The method includes detecting the internal temperature of the food ingredient by the temperature detector, and controlling the heater based on the internal temperature of the food ingredient detected by the temperature detector. The controlling of the heater includes performing a protein denaturation operation, in which a rate of internal temperature rise of the food ingredient is equal to or greater than a reference rate, based on the internal temperature of the food ingredient in a range of from a first reference temperature to a second reference temperature.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, like reference numerals will be understood to refer to like parts, components, and structures.

DETAILED DESCRIPTION

In view of a cook such as a chef, it is believed that (1) controlling a rate of temperature rise of food ingredient, and (2) adjusting a surface temperature and an internal temperature of food ingredient within a certain range, are required to make a delicious meal with the food ingredient. In many cases, a cook performs such temperature control with the naked eye or with the sense of smell. Further, in a heating cooker such a conventional oven, it is difficult to perform such temperature control because heating means is limited. It is assumed that (1) preparing a cooking process configured to control the rate of temperature rise of food ingredient, and (2) preparing a cooking process configured to adjust a reaching temperature of the food ingredient in a predetermined range, are needed in order to reproduce cooked food similar to that made by a chef, in a heating cooker. In various embodiments of the present disclosure, temperature sensing features are provided in the heating cooker in order to manage the internal temperature or surface temperature of the food ingredient required for such a cooking process. Therefore, it is possible to cook the food ingredient at a rate of temperature rise in accordance with ingredients of the food ingredient and processing characteristics of the food ingredient, and thus it is possible to sufficiently bring out flavor, textures, colors that indicate moderately baked food, and juiciness of the food ingredient. The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
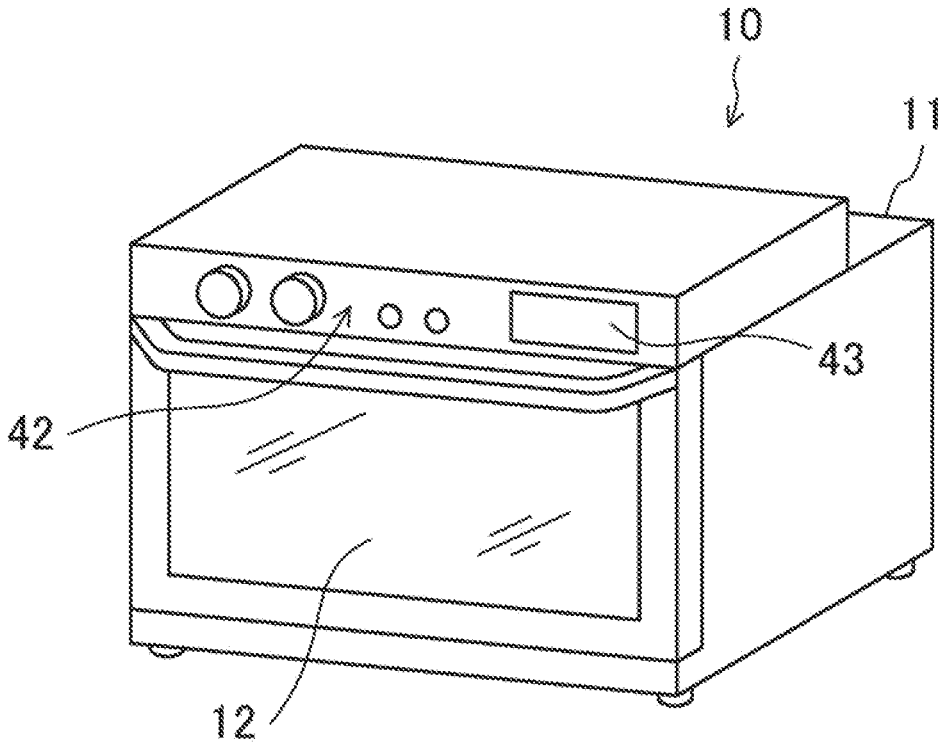
FIG. 1 is a perspective view illustrating an appearance of a heating cooker according to an embodiment of the disclosure.
Figure 2:
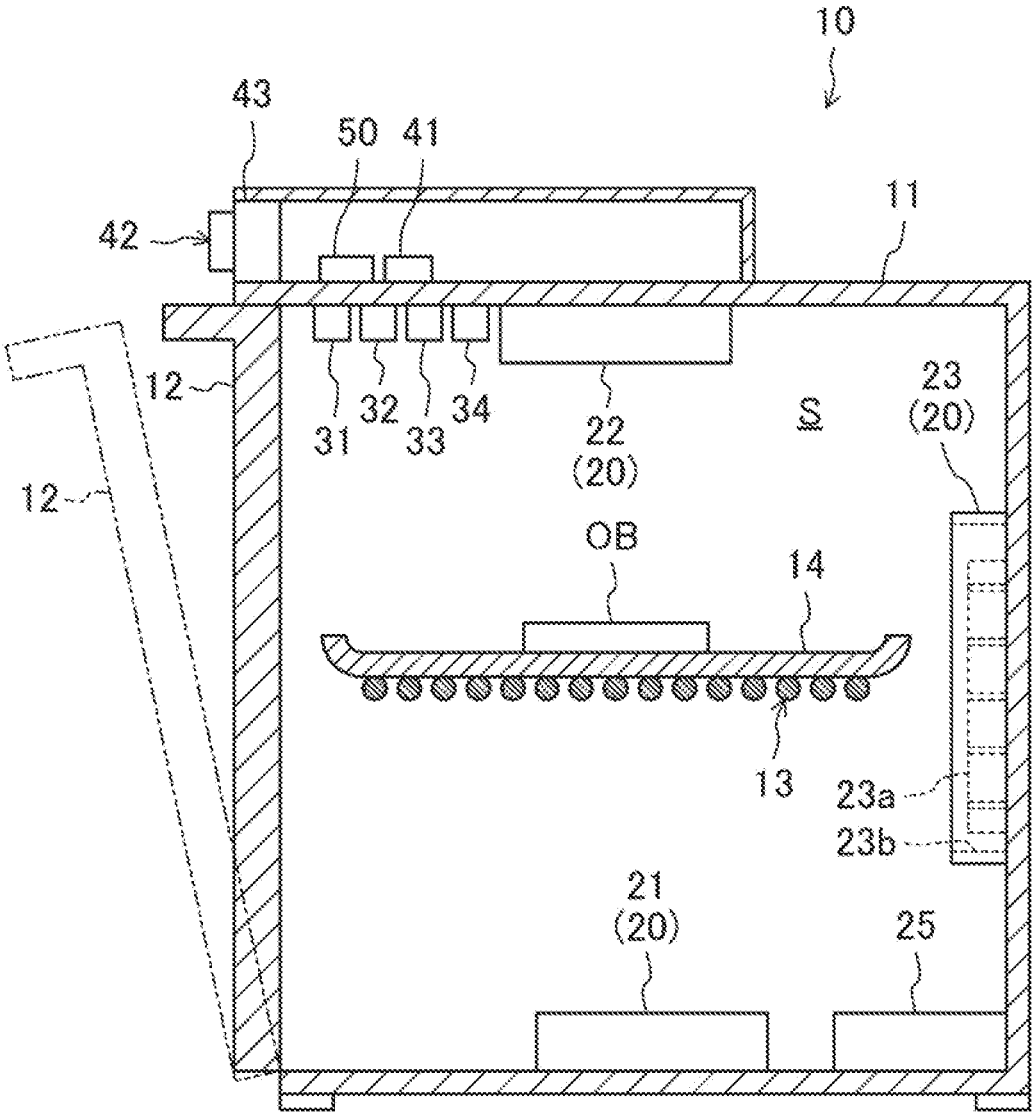
FIG. 2 is a cross-sectional view illustrating a configuration of the heating cooker according to an embodiment of the disclosure.

FIGS. 1 and 2 are views illustrating an appearance and a configuration of a heating cooker 10 according to various embodiments of the disclosure.

Referring to FIGS. 1 and 2, the heating cooker 10 heats and cooks a food ingredient OB (particularly, a food material including protein, such as thick-cut beef) based on a temperature of the food ingredient OB. In the embodiment, the heating cooker 10 includes a main body 11, a heater 20, a humidifier 25, a temperature detector 31, a three-dimensional measurement portion 32, an imaging portion 33, a chamber temperature detector 34, a storage 41, a manipulator 42, a display 43 and a controller 50 (e.g., at least one processor).

In addition, in the following description, directions (front, rear, left, right, upper, and lower) indicate a direction of the heating cooker 10 when viewed from a front side (a surface on which an opening and closing door 12 described later is provided).

Main Body

A heating chamber S is formed in the main body 11. The food ingredient OB is placed in the heating chamber S. In the embodiment, the main body 11 is formed in a box shape in a rectangular parallelepiped shape with a front opening, and an inner space of the main body 11 forms the heating chamber S.

The opening and closing door 12 is provided on the front (an opening surface) of the main body 11. A loading shelf 13 is provided in the inner space of the main body 11 (that is, the heating chamber S). The loading shelf 13 includes a plurality of rod members extending in a left and right direction and aligned in a front and rear direction, and opposite ends thereof in the left and right direction are supported on a side wall portion of the main body 11. A tray 14 is loaded on the loading shelf 13. The tray 14 may be formed in a plate shape formed of metal (for example, iron). The tray 14 may be loaded with the food ingredient OB.

Heater

The heater 20 heats an inside of the heating chamber S. An output of the heater 20 is adjustable. In the embodiment, the heater 20 includes a first heater 21, a second heater 22, and a third heater 23.

The first heater (lower heater) 21 is provided in a bottom wall portion of the main body 11 (that is, a lower portion of the heating chamber S), and the second heater (upper heater) 22 is provided in an upper wall portion of the main body 11 (that is, an upper portion of the heating chamber S). For example, the first heater 21 and the second heater 22 may be formed with a heating wire configured to generate heat by energization, or an infrared heater configured to radiate infrared rays, or formed with a combination with the heating wire and an infrared heater.

The third heater 23 is provided on a rear wall of the main body 11 (that is, a rear portion of the heating chamber S). In the embodiment, the third heater 23 is a so-called convection heater and includes a centrifugal fan 23*a* and a heat generating portion 23*b*. As the centrifugal fan 23*a* is rotated, the centrifugal fan 23*a* discharges air, which is sucked in a rotation axis direction, to a radial direction (that is, a direction perpendicular to the rotation axis direction). The rotation axis direction of the centrifugal fan 23*a* is a direction along the front and rear direction of the main body 11, and an inlet of the centrifugal fan 23*a* faces the front side of the main body 11. The heat generating portion 23*b* is formed to surround the periphery of the centrifugal fan 23*a*, and the heat generating portion 23*b* is a heating wire configured to generate heat by energization. By rotating the centrifugal fan 23*a* of the third heater 23, air in the heating chamber S may be circulated.

In addition, an output of the heater 20 depends on the number of the heater that is drivable and an output of the heater in a driving state among the plurality of heaters (the first heater 21, the second heater 22 and the third heater 23). Particularly, in a state in which the outputs of each of the plurality of heaters included in the heater 20 are the same, as the number of the heater that is drivable among the plurality of heaters is increased, the output of the heater 20 is increased. Further, as the output of the heater that is drivable among the plurality of heaters is increased, the output of the heater 20 is increased.

In addition, each of the heaters 21 to 23 included in the heater 20 may be configured to be switched to a continuous driving state in which the heaters are continuously driven, and an intermittent driving state in which the heaters are driven at a predetermined driving time in a predetermined driving period.

In addition, it is possible to change a ratio of the driving time to the driving period of the heaters 21 to 23. For example, as being changed from the continuous driving state to the intermittent driving state, the output of the first heater 21 is reduced. Further, based on a reduction in the ratio of the driving time to the driving period of the first heater 21 in the intermittent driving state, the output of the first heater 21 is reduced.

Humidifier

The humidifier (steam generator) 25 generates steam in the heating chamber S. For example, the humidifier 25 may be provided with a known steam generator configured to generate steam by heating water and discharge steam into the heating chamber S.

Particularly, the humidifier 25 may include a tank (not shown) configured to store water, a pump (not shown) configured to transport water stored in the tank, and a heater (not shown) configured to generate steam by heating the water transported by the pump. The humidifier 25 may discharge steam, which is generated by the heater, to the inside of the heating chamber S.

Temperature Detector

The temperature detector 31 detects an internal temperature of the food ingredient OB. In the embodiment, the temperature detector 31 may measure a surface temperature of the food ingredient OB in a non-contact manner, and estimate the internal temperature of the food ingredient OB based on the measured surface temperature of the food ingredient OB.

Particularly, the temperature detector 31 may measure heat distribution of region (measurement target region) containing the food ingredient OB. For example, the temperature detector 31 may include a plurality of infrared sensors configured to detect infrared rays emitted from the measurement target region. Based on a thickness of the food ingredient OB (for example, beef) being 3 cm or more, the temperature detector 31 may detect a temperature within 1 cm from the surface of the food ingredient OB as the internal temperature of the food ingredient OB.

The temperature detector 31 may transmit a measurement result (information indicating the surface temperature of the food ingredient OB measured by the temperature detector 31) to the controller 50, and the controller 50 may estimate the internal temperature of the food ingredient OB based on the measurement result.

In addition, the temperature detector 31 may detect an internal temperature in at least two parts of the food ingredient OB, and the controller 50 may control the heater 20 based on the lowest temperature among the at least two internal temperatures detected by the temperature detector 31.

In addition, the temperature detector 31 may be one or a plurality of contact-type probes configured to directly detect the internal temperature of the food ingredient OB.

Three-Dimensional Measurement Portion

The three-dimensional measurement portion 32 may measure a three-dimensional shape of the food ingredient OB, which is placed inside of the heating chamber S, thereby deriving three-dimensional information indicating the three-dimensional shape of the food ingredient OB. Particularly, the three-dimensional information may include three-dimensional coordinates representing the three-dimensional shape of the object. For example, the three-dimensional measurement portion 32 is provided with a known three-dimensional measuring device such as a Time of Flight (TOF) camera or a stereo camera. The three-dimensional information derived by the three-dimensional measurement portion 32 is transmitted to the controller 50.

Imaging Portion

The imaging portion (color detector) 33 images a region including a surface of the food ingredient OB placed in the heating chamber S (imaging target region), thereby obtaining the imaged image including the surface of the food ingredient OB. For example, the imaging portion 33 may be implemented with a known imaging device such as a charge-coupled device (CCD) camera or a complementary metal-oxide-semiconductor (CMOS) camera. It is possible to detect a roasted color of a surface of the food ingredient OB by imaging the surface of the food ingredient OB by the imaging portion 33. The imaged image obtained by the imaging portion 33 is transmitted to the controller 50.

In the embodiment, the imaging portion 33 may detect the roasted color of the surface of the food ingredient OB, but alternatively, the imaging portion 33 may estimate the roasted color of the surface of the food ingredient OB based on the surface temperature of the food ingredient OB measured by the temperature detector 31. In contrast, the temperature detector 31 may estimate the internal temperature of the food ingredient OB based on the roasted color of the surface of the food ingredient OB obtained by the imaging portion 33. In this case, the temperature detector 31 may estimate the surface temperature of the food ingredient OB based on the roasted color of the surface of the food ingredient OB detected by the imaging portion 33, and may estimate the internal temperature of the food ingredient OB based on the estimated surface temperature of the food ingredient OB.

Chamber Temperature Detector

The chamber temperature detector 34 detects a temperature of an inside of the heating chamber S (hereinafter referred to as an indoor temperature). Particularly, the chamber temperature detector 34 detects a temperature of air in the heating chamber S. In the embodiment, the chamber temperature detector 34 is installed in the heating chamber S, and detects a temperature of air at an installation location of the chamber temperature detector 34 as the temperature in the heating chamber S. For example, the chamber temperature detector 34 may be implemented with a known temperature sensor configured to detect a temperature of air. A detection result of the chamber temperature detector 34 (that is, information indicating an indoor temperature detected by the chamber temperature detector 34) is transmitted to the controller 50.

Storage

The storage 41 stores information. For example, the storage 41 is provided with a known storage device such as a hard disk. In addition, the storage 41 may be provided on the outside of the main body 11. For example, the storage 41 may be provided as an external storage device (not shown) provided on the outside of the main body 11.

In the embodiment, the storage 41 may store images prepared for each kind of the food ingredient OB (images including the food ingredient OB). It is possible to identify the type of the food ingredient OB by comparing the imaged image (the imaged image including the food ingredient OB placed in the heating chamber S) obtained by the imaging portion 33 with the image stored in the storage 41.

In addition, in the embodiment, the storage 41 may store a heating cooking model that is set for each combination of the type and size of the food ingredient OB. At this time, the size of the food ingredient OB may be a thickness of the food ingredient OB, a volume of the food ingredient OB, a surface area of the food ingredient OB, a weight of the food ingredient OB, or a combination of at least two of these. For example, the weight of the food ingredient OB may be calculated from the volume of the food ingredient OB. Further, in a case in which a weight detector (not shown) configured to detect a weight of the food ingredient OB is provided in the heating cooker 10, the weight of the food ingredient OB may be calculated based on the output of the weight detector. The heating cooking model will be described in detail later.

Manipulator

The manipulator 42 is manipulated by an operator of the heating cooker 10, and information, which is on the given situation, is input to the manipulator 42 by the operator. In the embodiment, the manipulator 42 is given a manipulation for designating a cooking method of the food ingredient. For example, the manipulator 42 may be implemented with a manipulation button. Information input to the manipulator 42 is transmitted to the controller 50.

Display

The display 43 displays information. In the embodiment, the display 43 displays setting information for heating cooking. Particularly, information indicating an output of the heater 20 or information indicating a time required for heating cooking may be displayed on the display 43. For example, the display 43 may be implemented as a known display device, such as a liquid crystal display device.

Figure 3:
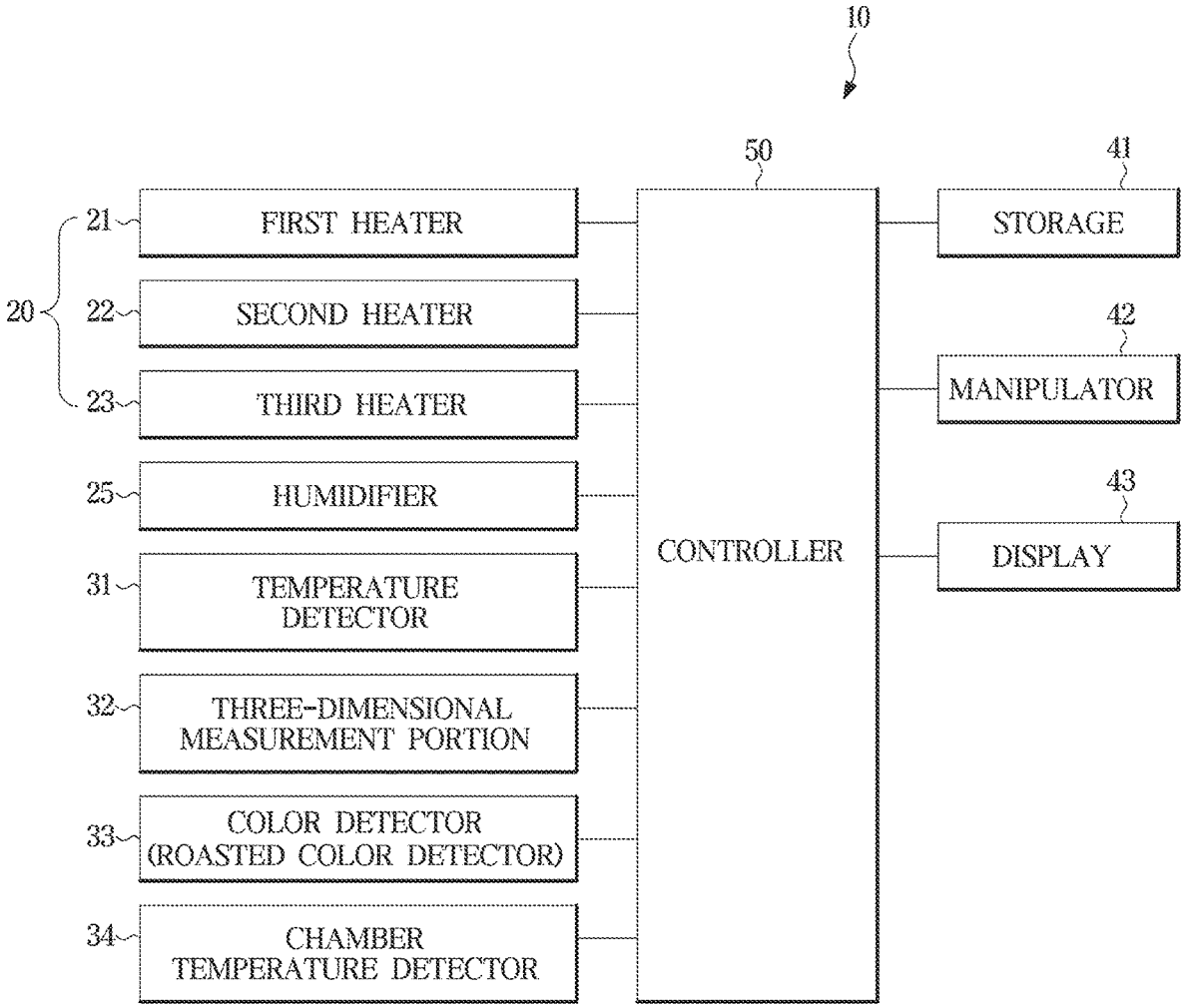
FIG. 3 is a diagram illustrating the configuration of the heating cooker according to an embodiment of the disclosure.

FIG. 3 is a diagram illustrating the configuration of the heating cooker according to an embodiment of the disclosure.

Controller

Referring to FIG. 3, the controller 50 may transmit and receive information to and from each component of the heating cooker 10 by being electrically connected to each component of the heating cooker 10 (the heater 20, the humidifier 25, the temperature detector 31, the three-dimensional measurement portion 32, the imaging portion 33, the chamber temperature detector 34, the storage 41, the manipulator 42, and the display 43 in the embodiment)

The controller 50 may control the operation of the heating cooker 10 by controlling each component of the heating cooker 10 based on information transmitted from each component of the heating cooker 10. For example, the controller 50 may include a processor, and a memory configured to store a program or information for operating the processor.

Figure 4:
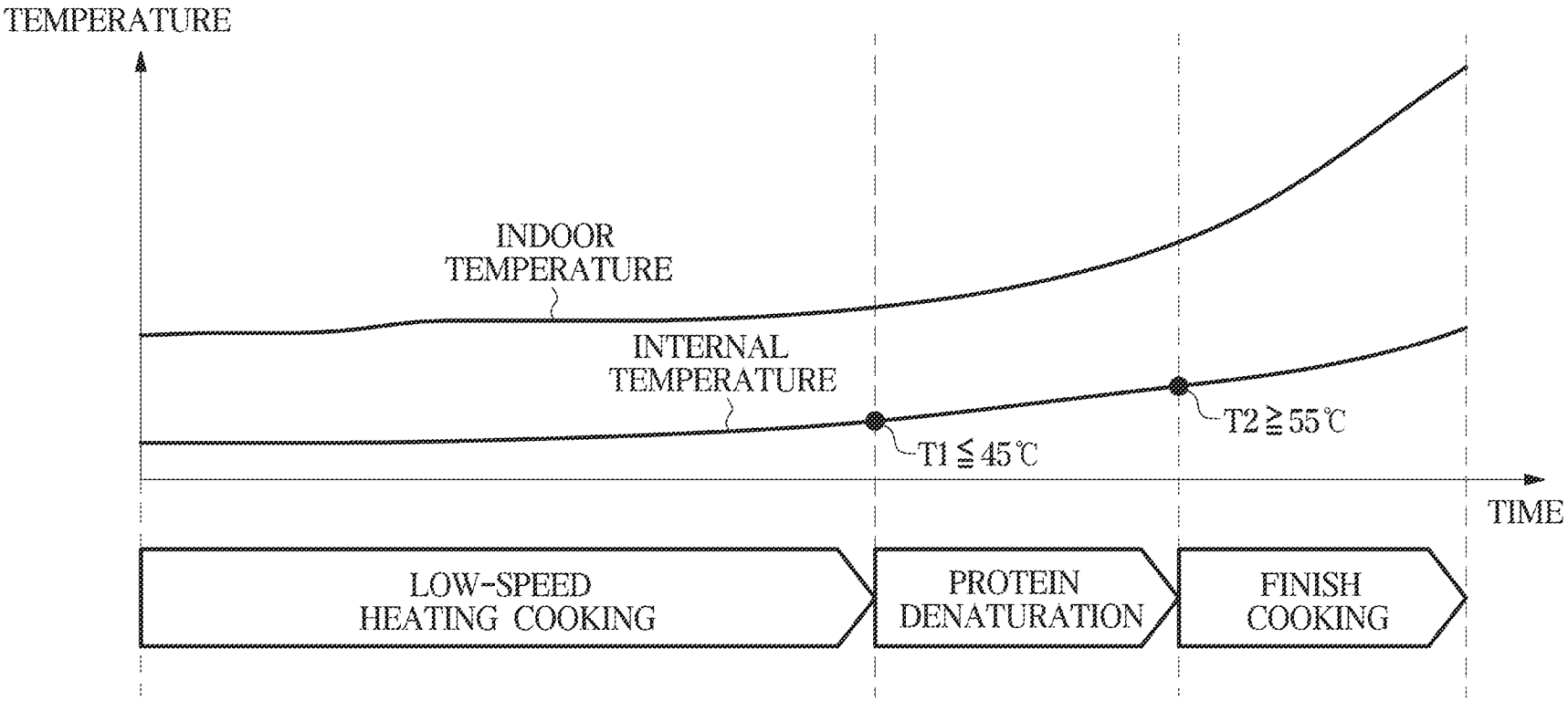
FIG. 4 is a diagram illustrating temperature control of the heating cooker according to an embodiment of the disclosure.

FIG. 4 is a diagram illustrating temperature control of the heating cooker according to an embodiment of the disclosure.

Referring to FIG. 4, the heating cooker 10 according to the embodiment may perform "low-speed heating cooking operation", "protein denaturation operation" and "finish cooking operation".

In "low-speed heating cooking operation", the controller 50 heats the inside of the heating chamber S by the heater 20 so as to allow a rate of internal temperature rise of the food ingredient OB to be a first reference rate (for example, 1.5K/min) or less.

In "protein denaturation operation", the controller 50 heats the inside of the heating chamber S by the heater 20, so as to control a rate of internal temperature rise of the food ingredient OB to be equal to or greater than a second reference rate (for example, 3K/min), which is greater than the first reference rate.

The protein denaturation operation is performed when the internal temperature of the food ingredient OB is within a reference range. The reference range may be a range of from a first reference temperature to a second reference temperature, and the first reference temperature may be 45° C. or less, and the second reference temperature may be 55° C. or more. Also, the first reference temperature may be equal to or greater than 40° C. and equal to or less than 45° C., and the second reference temperature may be equal to or greater than 55° C. and equal to or less than 60° C. For example, at the internal temperature of the object B in a range of from 45° C. to 55° C., the protein denaturation operation may be performed.

In "finish cooking operation," the controller 50 heats the inside of the heating chamber S by the heater 20 to allow a reaching temperature of the food ingredient OB (the surface temperature and the internal temperature of the food ingredient OB) to be in a predetermined range.

The controller 50 may control not only the internal temperature (the surface temperature and the internal temperature) of the food ingredient OB, but also the indoor temperature.

The controller 50 may control the heater 20 to perform "protein denaturation operation" after performing "low-speed heating cooking operation", and to perform "finish cooking operation" after performing "protein denaturation operation". Particularly, based on a predetermined first operation switching condition being satisfied during "low-speed heating cooking operation", the controller 50 may terminate "low-speed heating cooking operation" and then start "protein denaturation operation". In addition, based on a predetermined second operation switching condition being satisfied during "protein denaturation operation", the controller 50 may terminate "protein denaturation operation" and then start "finish cooking operation". In addition, based on a predetermined operation completion condition being satisfied during "finish cooking operation", the controller 50 may control the heater 20 to terminate "finish cooking operation".

In addition, the controller 50 may set the first and second operation switching conditions according to at least one of the type and size of the food ingredient OB.

In addition, the controller 50 may set the operation completion condition according to at least one of the type and size of the food ingredient OB. The first and second operation switching conditions and the operation completion condition will be described in detail later.

In addition, the controller 50 may set the output of the heater 20 about at least one of "low-speed heating cooking operation" "protein denaturation operation", and "finish cooking operation" according to at least one of the type and size of the food ingredient OB.

At this time, in the embodiment, the controller 50 may adjust the output of the heater 20 by adjusting the number of heaters that is drivable and the output of heaters in the driving state among the first heater 21, the second heater 22, and the third heater 23 contained in the heater 20.

Further, the controller 50 may switch the heater, which is drivable among the first heater 21, the second heater 22, and the third heater 23 contained in the heater 20, to the continuous driving state and the intermittent driving state, thereby adjusting the output of the heater.

In addition, the controller 50 may adjust the ratio of the driving time to the driving period of the heater in the intermittent driving state among the first heater 21, the second heater 22, and the third heater 23 included in the heater 20, thereby adjusting the output of the heater.

Heating Cooking Model

Next, a heating cooking model stored in the storage 41 will be described. As described above, the storage 41 may store a heating cooking model set for each combination of the type and size of the food ingredient OB. The heating cooking model includes the first operation switching condition, the second operation switching condition, the operation completion condition, an operation condition of "low-speed heating cooking operation", an operation condition of "protein denaturation operation", and an operation condition of "finish cooking operation".

<First and Second Operation Switching Conditions>

The first operation switching condition is a condition to switch "low-speed cooking operation" to "protein denaturation operation". In the embodiment, the first operation switching condition is a condition that the internal temperature of the food ingredient OB reaches a predetermined first switching internal temperature T1 (for example, T1≤45° C.) (the first switching operation condition). The heating cooking model represents a first switching internal temperature T1 that is a criterion for determining whether or not the first operation switching condition is satisfied.

The second operation switching condition is a condition to switch "protein denaturation operation" to "finish cooking operation". In the embodiment, the second operation switching condition is a condition that the internal temperature of the food ingredient OB reaches a predetermined second switching internal temperature T2 (for example, T2≥55° C.) (the second switching operation condition). The heating cooking model represents a second switching internal temperature T2 that is a criterion for determining whether or not the second operation switching condition is satisfied.

By the first switching internal temperature T1 and the second switching internal temperature T2, the first reference temperature and the second reference temperature indicating a temperature range in the protein denaturation operation may be determined.

Further, the first and second operation switching conditions indicated in the heating cooking model are set to conditions suitable for at least one of the type and size of the food ingredient OB corresponding to the heating cooking model. That is, the first and second operation switching conditions may be set according to at least one of the type and size of the food ingredient OB. In the embodiment, the first and second switching internal temperatures T1 and T2 indicated in the heating cooking model may be set according to at least one of the type and size of the food ingredient OB corresponding to the heating cooking model.

For example, as the size of the food ingredient OB increases, the first switching internal temperature T1 (a maximum reaching temperature in "low-speed heating cooking operation") increases. Further, the second switching internal temperature T2 (a maximum reaching temperature in "protein denaturation operation") may be set based on a level of cooked or a state of fat as well as the type and size of the food ingredient OB. Further, the first switching internal temperature T1 may be set based on the second switching internal temperature T2 configured as described above.

The controller 50 may select a heating cooking model corresponding to the type and size of the food ingredient OB, that is, an object to be heated, from among the plurality of heating cooking models, and the controller 50 may determine the first and second operation switching conditions based on the selected heating cooking model. That is, the controller 50 may set the first and second operation switching conditions (in the embodiment, the first and second switching internal temperatures T1 and T2) according to at least one of the type and size of the food ingredient OB.

<Operation Completion Condition>

The operation completion condition is a condition to complete "finish cooking operation". In the embodiment, the operation completion condition is a condition (completion criteria) that a surface temperature of the food ingredient OB reaches a predetermined target surface temperature, and an internal temperature of the food ingredient OB reaches a predetermined target internal temperature. The heating cooking model may represent a target surface temperature and a target internal temperature, which are criteria for determining whether or not the operation completion condition is satisfied.

Further, the operation completion condition indicated in the heating cooking model is set to a condition suitable for at least one of the type and size of the food ingredient OB corresponding to the heating cooking model. That is, the operation completion condition may be set according to at least one of the type and size of the food ingredient OB. In the embodiment, the target surface temperature and the target internal temperature indicated in the heating cooking model are set according to at least one of the type and size of the food ingredient OB corresponding to the heating cooking model.

The controller 50 may select a heating cooking model corresponding to the type and size of the food ingredient OB, that is, an object to be heated, from among the plurality of heating cooking models, and the controller 50 may determine the operation completion condition based on the selected heating cooking model. That is, the controller 50 may set the operation completion condition (in the embodiment, the target surface temperature and the target internal temperature) according to at least one of the type and size of the food ingredient OB.

In this case, for example, the target surface temperature is set to a temperature that sufficiently heats the surface of the food ingredient OB or that does not burn the surface of the food ingredient OB (for example, 160° C. to 180° C.). For example, the target internal temperature is set to a temperature that sufficiently heats and sterilizes the inside of the food ingredient OB (for example, 58° C. or more).

<Operation Conditions of Low-Speed Heating Cooking Operation>

Operation conditions of the low-speed heating cooking operation include an output (target output) of the heater 20 in the low-speed heating cooking operation. The output of the heater 20 in the low-speed heating cooking operation is set to allow an average rate of internal temperature rise of the food ingredient OB in the low-speed heating cooking operation to be equal to or less than an average rate of reference temperature rise of the food ingredient OB in the protein denaturation operation. For example, the output of the heater 20 in the low-speed heating cooking operation may be set to allow the average rate of internal temperature rise of the food ingredient OB to be in a predetermined allowable rate range (the above described first reference rate, for example, 1.5K/min or less). For example, the allowable rate range may be set to a rate range capable of preventing quality deterioration of the food ingredient OB (for example, a case in which the food ingredient OB is too stiff) caused by a rapid increase in the internal temperature of the food ingredient OB.

The output of the heater 20 in the low-speed heating cooking operation indicated in the heating cooking model is set to an output suitable for at least one of the type and size of the food ingredient OB corresponding to the heating cooking model. That is, the output of the heater 20 in the low-speed heating cooking operation may be set according to at least one of the type and size of the food ingredient OB. For example, as the size of the food ingredient OB increases, the output of the heater 20 in the low-speed heating cooking operation may increase.

The controller 50 selects a heating cooking model corresponding to the type and size of the food ingredient OB, that is, an object to be heated, from among the plurality of heating cooking models, and the controller 50 determines the output (target output) of the heater 20 in the low-speed heating cooking operation, based on the selected heating cooking model. That is, the controller 50 may set the output (target output) of the heater 20 in the low-speed heating cooking operation according to at least one of the type and size of the food ingredient OB.

Based on the thickness of the food ingredient OB (for example, beef) being a reference thickness (for example, 1 cm) or less, the controller 50 may control the heater 20 to omit the low-speed heating cooking operation and to start the protein denaturation operation described later.

<Operation Conditions of Protein Denaturation Operation>

Operation conditions of the protein denaturation operation include an output (target output) of the heater 20 in the protein denaturation operation. For example, the output of the heater 20 in the protein denaturation operation may be set to allow a rate of internal temperature rise of the food ingredient OB in the protein denaturation operation to be equal to or greater than 3K/min, appropriately, equal to or greater than 3.5K/min based on an internal temperature of the food ingredient OB in a rage of from 45° C. or more to 55° C. or less. By such rapid heating, the food ingredient OB may be roasted in a short period of time in a temperature range of myosin denaturation, for example, a temperature range of from 45° C. to 55° C., and thus it is possible to keep the juiciness of the inside of the food ingredient OB (for example, meat). Therefore, the meat becomes tender and the meat juice is formed, which improves the flavor and texture.

The output of the heater 20 in the protein denaturation operation indicated in the heating cooking model is set to an output suitable for at least one of the type and size of the food ingredient OB corresponding to the heating cooking model. That is, the output of the heater 20 in the protein denaturation operation may be set according to at least one of the type and size of the food ingredient OB. For example, as the size of the food ingredient OB increases, the output of the heater 20 in the protein denaturation operation may increase.

The controller 50 selects a heating cooking model corresponding to the type and size of the food ingredient OB, that is, an object to be heated, from among the plurality of heating cooking models, and the controller 50 determines the output (target output) of the heater 20 in the protein denaturation operation, based on the selected heating cooking model. That is, the controller 50 may set the output (target output) of the heater 20 in the protein denaturation operation according to at least one of the type and size of the food ingredient OB.

In terms of prevention of burning the food ingredient OB, the controller 20 may control the heater 20 to allow a rate of internal temperature rise of the food ingredient OB in the protein denaturation operation to be equal to less than 50K/min, appropriately, equal to or less than 30K/min, more appropriately, equal to or less than 10K/min.

Based on an operation completion condition of the finish cooking operation, which is described later, being satisfied at the time of termination of the protein denaturation operation, the controller 50 may terminate the heating performed by the heater 20.

<Operation Conditions of Finish Cooking Operation>

Operation conditions of the finish cooking operation include an output (target output) of the heater 20 in the finish cooking operation. An output of the heater 20 in the finish cooking operation may be set to allow the internal temperature of the food ingredient OB in the finish cooking operation to be rapidly increased as possible as and at the same time, may be set to prevent an increase in an inside temperature (indoor temperature) of the heating chamber S to prevent burning of the food ingredient OB.

The output of the heater 20 in the finish cooking operation indicated in the heating cooking model is set to an output suitable for at least one of the type and size of the food ingredient OB corresponding to the heating cooking model. That is, the output of the heater 20 in the finish cooking operation may be set according to at least one of the type and size of the food ingredient OB. For example, as the size of the food ingredient OB increases, the output of the heater 20 in the finish cooking operation may increase.

The controller 50 selects a heating cooking model corresponding to the type and size of the food ingredient OB, that is, an object to be heated, from among the plurality of heating cooking models, and the controller 50 determines the output (target output) of the heater 20 in the finish cooking operation, based on the selected heating cooking model. That is, the controller 50 may set the output (target output) of the heater 20 in the finish cooking operation according to at least one of the type and size of the food ingredient OB.

In the finish cooking operation, the controller 50 may control the heater 20 based on the roasted color of the surface of the food ingredient OB detected by the imaging portion 33.

Figure 5:
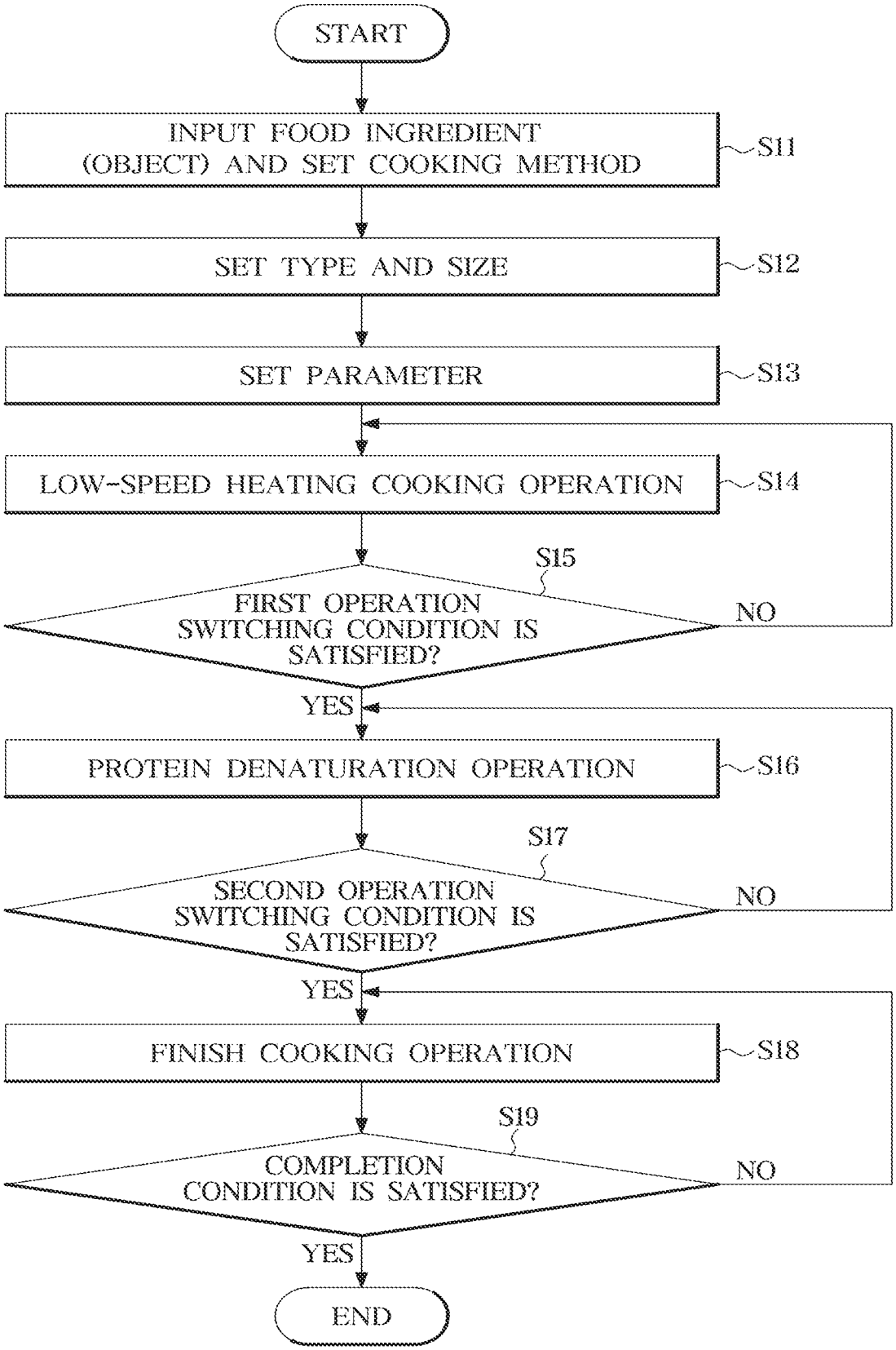
FIG. 5 is a flow chart illustrating an operation of the heating cooker according to an embodiment of the disclosure.

FIG. 5 is a flow chart illustrating an operation of the heating cooker according to an embodiment of the disclosure.

Operation of the Heating Cooker

The operation of the heating cooker 10 according to the embodiment will be described with reference to FIG. 5.

<Operation 11>

First, the food ingredient OB is put into the heating chamber S. An operator provides the manipulator 42 with a cooking method designation manipulation, which is a manipulation for designating a cooking method of the food ingredient OB. The controller 50 determines the cooking method of the food ingredient OB placed in the heating chamber S based on the cooking method designation manipulation given to the manipulator 42. In the embodiment, the heating cooking is designated as the cooking method of the food ingredient OB.

<Operation 12>

Next, the three-dimensional measurement portion 32 measures the three-dimensional shape of the food ingredient OB arranged in the heating chamber S, and derives three-dimensional information indicating the three-dimensional shape of the food ingredient OB. The imaging portion 33 images a region (an imaging target region) including the food ingredient OB disposed in the heating chamber S, and obtains the imaged image including the food ingredient OB. The controller 50 compares the imaged image obtained by the imaging portion 33 with the image for each type of food ingredient stored in the storage 41, and based on a result of the comparison, the controller 50 identifies the type of the food ingredient OB arranged in the heating chamber S. In addition, the controller 50 may identify the size of the food ingredient OB placed in the heating chamber S based on the three-dimensional information derived by the three-dimensional measurement portion 32.

<Operation 13>

Subsequently, the controller 50 determines various control parameters for the heating cooking based on the type and size of the food ingredient OB identified in operation 12. Particularly, the controller 50 selects a heating cooking model, which corresponds to the combination of the type and size of the food ingredient OB identified in operation S12, from among the plurality of heating cooking models stored in the storage 41. Based on the selected heating cooking model, the controller 50 determines the first and second operation switching conditions, the operation completion condition, the operation condition of the low-speed heating cooking operation (the output of the heater 20 in the low-speed heating cooking operation), the operation condition of the protein denaturation operation (the output of the heater 20 in the protein denaturation operation), and the operation condition of the finish cooking operation (the output of the heater 20 in the finish cooking operation).

<Operation 14>

The controller 50 controls the heater 20 to perform the low-speed heating cooking operation. Particularly, the controller 50 controls the heater 20 to allow the output of the heater 20 to be the output (target output of the heater 20 in the low-speed heating cooking operation.

<Operation 15>

The controller 50 determines whether or not the first operation switching condition is satisfied. In the embodiment, based on the internal temperature of the food ingredient OB reaching the first switching internal temperature T1 (T1≤45° C.), the first operation switching condition may be satisfied. Based on the first operation switching condition not being satisfied, the process returns to operation 14. Accordingly, the low-speed heating cooking operation is continued until the first operation switching condition is satisfied. On the other hand, based on the first operation switching condition being satisfied, the process proceeds to operation 16.

<Operation 16>

The controller 50 controls the heater 20 to perform the protein denaturation operation. Particularly, the controller 50 controls the heater 20 to allow the output of the heater 20 to be the output (target output of the heater 20 in the protein denaturation operation.

<Operation 17>

The controller 50 determines whether or not the second operation switching condition is satisfied. In the embodiment, based on the internal temperature of the food ingredient OB reaching the second switching internal temperature T2, the second operation switching condition may be satisfied. Based on the second operation switching condition not being satisfied, the process returns to operation 16. Accordingly, the protein denaturation operation is continued until the second operation switching condition is satisfied. On the other hand, based on the second operation switching condition being satisfied, the process proceeds to operation 18.

<Operation 18>

The controller 50 controls the heater 20 to perform the finish cooking operation. Particularly, the controller 50 controls the heater 20 to allow the output of the heater 20 to be the output (target output of the heater 20 in the finish cooking operation.

<Operation 19>

The controller 50 determines whether or not the operation completion condition is satisfied. In the embodiment, based on the surface temperature of the food ingredient OB reaching the target surface temperature and based on the internal temperature of the food ingredient OB reaching the target internal temperature of the food ingredient OB, the operation completion condition may be satisfied. Based on the operation completion condition not being satisfied, the process returns to operation 18. Accordingly, the finish cooking operation is continued until the operation completion condition is satisfied. On the other hand, based on the operation completion condition being satisfied, the operation is terminated.

Figure 6:
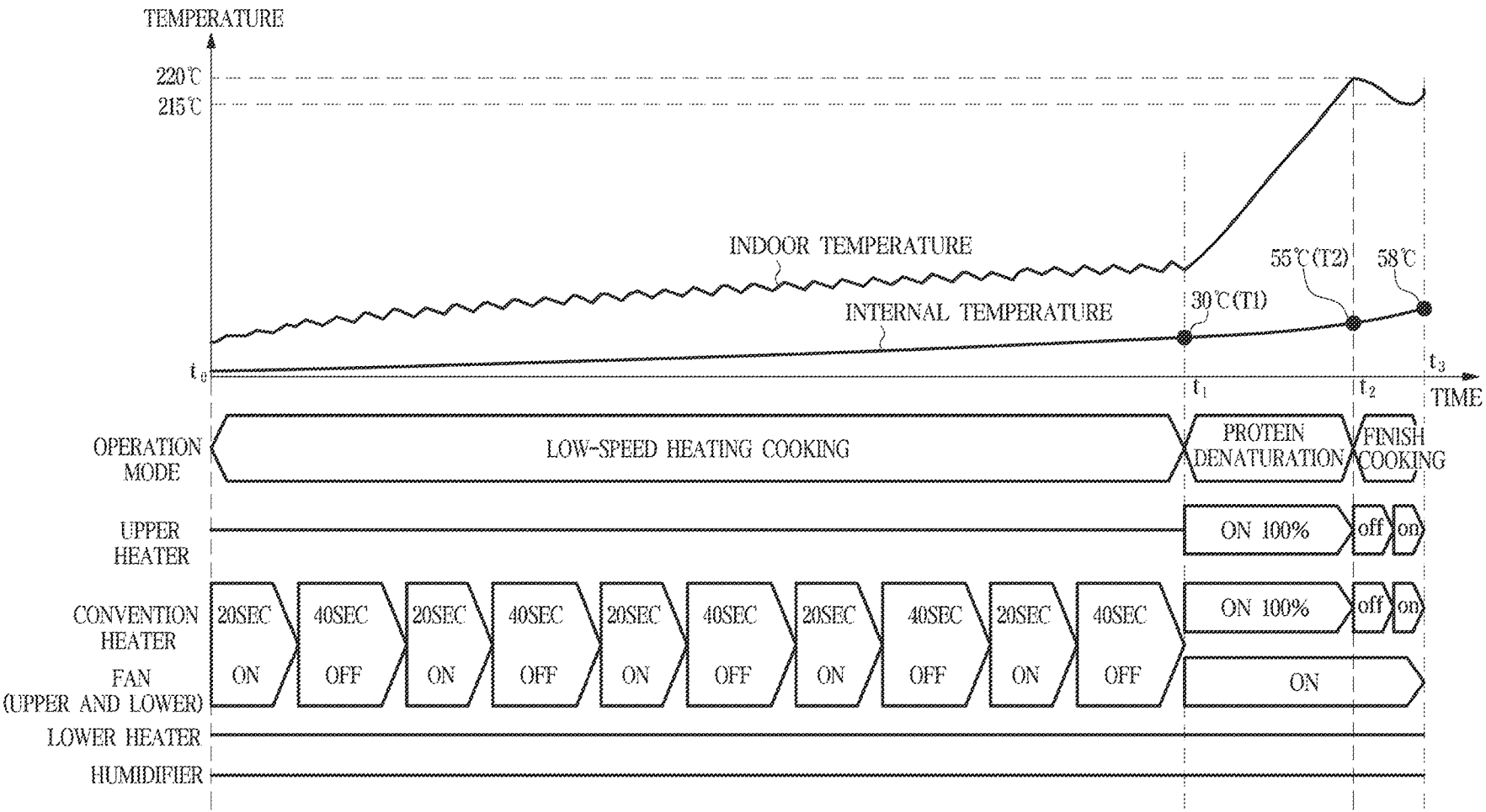
FIG. 6 is a timing chart illustrating the operation of the heating cooker according to an embodiment of the disclosure.

FIG. 6 is a timing chart illustrating the operation of the heating cooker according to an embodiment of the disclosure.

Example of Operation of Heating Cooker

An example of the operation of the heating cooker 10 according to the embodiment will be described with reference to FIG. 6.

At time t0, the low-speed heating cooking operation is started. In the embodiment, the third heater (convection heater) 23 is in a driving state (particularly, the intermittent driving state). Accordingly, heating in the heating chamber S is started.

In a period from the time t0 to time t1, the low-speed heating cooking operation continues. Particularly, an operation, in which the heat generating portion and the centrifugal fan of the third heater are turned on for 20 seconds and turned off for 40 seconds, may be performed a plurality of times. Accordingly, the temperature (the indoor temperature) of the heating chamber S may be gradually increased, and the internal temperature of the food ingredient OB placed in the heating chamber S may be gradually increased. In the embodiment, the average rate of the internal temperature rise of the food ingredient OB in the low-speed heating cooking operation is within a predetermined allowable rate range (for example, 1.5 K/min or less).

At the time t1, the internal temperature of the food ingredient OB reaches the first switching internal temperature T1 (30° C. in the embodiment). Accordingly, based on the first operation switching condition being satisfied, the low-speed heating cooking operation is terminated, and the protein denaturation operation is started. In this example, the driving state of the third heater (convection heater) 23 is changed from the intermittent driving state to the continuous driving state, and the second heater (upper heater) 22 is changed from a stop state to a driving state (particularly, the continuous driving state), and thus the output of the heater 20 is increased.

In a period from the time t1 to time t2, the protein denaturation operation continues. Accordingly, the temperature (the indoor temperature) of the heating chamber S may be rapidly increased, and the surface temperature and the internal temperature of the food ingredient OB placed in the heating chamber S may be rapidly increased. In this case, the average rate of the internal temperature rise of the food ingredient OB in the protein denaturation operation is greater than the average rate of the internal temperature rise of the food ingredient OB in the low-speed heating cooking operation.

At the time t2, the internal temperature of the food ingredient OB reaches the second switching internal temperature T2 (55° C. in the embodiment). Accordingly, based on the second operation switching condition being satisfied, the protein denaturation operation is terminated, and the final cooking operation is started. In this example, the driving state of the heat generating portion among the third heater (convection heater) 23 is changed from the continuous driving state to the intermittent driving state, and the driving state of the second heater (upper heater) 22 is also changed from the continuous driving state to the intermittent driving state, and thus the output of the heater 20 is reduced.

In a period from the time t2 to time t3, the finish cooking operation continues. In this example, in the period from the time t2 to the time t3, the temperature of the heating chamber S (the indoor temperature of the chamber) is once lowered from 220° C. to 215° C. That is, while an increase in the indoor temperature is suppressed in order to prevent burning of the food ingredient OB, the internal temperature of the food ingredient OB is increased.

At the time t3, the internal temperature of the food ingredient OB reaches the target internal temperature (58° C., in the embodiment). In this example, the surface temperature of the food ingredient OB has reached the target surface temperature (215° C. in the embodiment) before the time t3. Therefore, at the time t3, the operation completion condition is satisfied and the finish cooking operation is terminated.

In addition, in the example of FIG. 6, the period of the protein denaturation operation (the period from the time t1 to the time t2), in which the protein denaturation operation is performed, is less than the period of the low-speed heating cooking operation (the period from the time t0 to the time t1), in which the low-speed heating cooking operation is performed. The period of the final cooking operation (the period from the time t2 to the time t3), in which the finish operation is performed, is less than the period of the protein denaturation operation (the period from the time t1 to the time t2).

Further, in the latter part of the low-speed heating cooking operation, the humidifier 25 may be driven to prevent a dry state caused by oven cooking. In addition, in the low-speed heating cooking operation, forced convection by a fan may be generated in the heating chamber S in order to eliminate temperature deviation and ensure uniformity during the low-temperature cooking. In addition, in the protein denaturation operation, the first heater (lower heater) 21 may be operated to obtain a desired rate of the internal temperature rise of the food ingredient OB. In addition, in each operation, the output variable control of a single heater may be performed instead of the combination control with the plurality of heaters. As a cooling method for the chamber in the finish cooking operation, the opening and closing door 12 may be automatically opened or convection may be generated with a fan. Further, based on the size of the food ingredient OB derived by the three-dimensional measurement portion 32 (for example, the thickness of meat), the first and second operation switching conditions (the first and second switching internal temperatures T1 and T2) may also be changed.

In addition, in the example of FIG. 6, the case, in which the protein denaturation operation is started from the point of time in which the internal temperature of the food ingredient OB reaches 30° C., has been described. However, it is appropriate that the protein denaturation operation is performed based on the internal temperature of the food ingredient OB in the range of from 45° C. to 55° C., and thus the low-speed heating cooking operation may continue until the internal temperature of the food ingredient OB reaches 45° C. Alternatively, in order to increase or reduce the cooking time and the level of the roasting, an additional cooking operation, such as that the rate of the internal temperature rise of the food ingredient OB is in the middle of the low-speed heating cooking operation and the protein denaturation operation, may be performed based on the internal temperature of the food ingredient OB in the range of from 30° C. to 45° C.

Effect of Embodiment

As mentioned above, in the embodiment, the controller 50 controls the heater 20 to perform the protein denaturation operation, in which the rate of the internal temperature rise of the food ingredient OB is 3K/min or more at the internal temperature of the food ingredient OB in the range of from 45° C. to 55° C. based on the internal temperature of the food ingredient OB detected by the temperature detector 31, thereby obtaining the following effects. That is, by roasting the food ingredient OB in a short time with the temperature range of 45° C. to 55° C. that is a myosin denaturation temperature range, it is possible to keep the juiciness of the inside of the food ingredient OB, particularly, the meat. Therefore, the meat becomes tender and juicy, and the flavor and texture are improved. On the other hand, as the conventional manner, when the increase in the internal temperature of the food ingredient OB is suppressed to prevent muscle contraction in the meat and the meat is cooked lightly, an amount of outflow of juiciness may be increased over time after cooking and thus it may lead to a difficulty that the meat becomes stiff.

Figure 7:
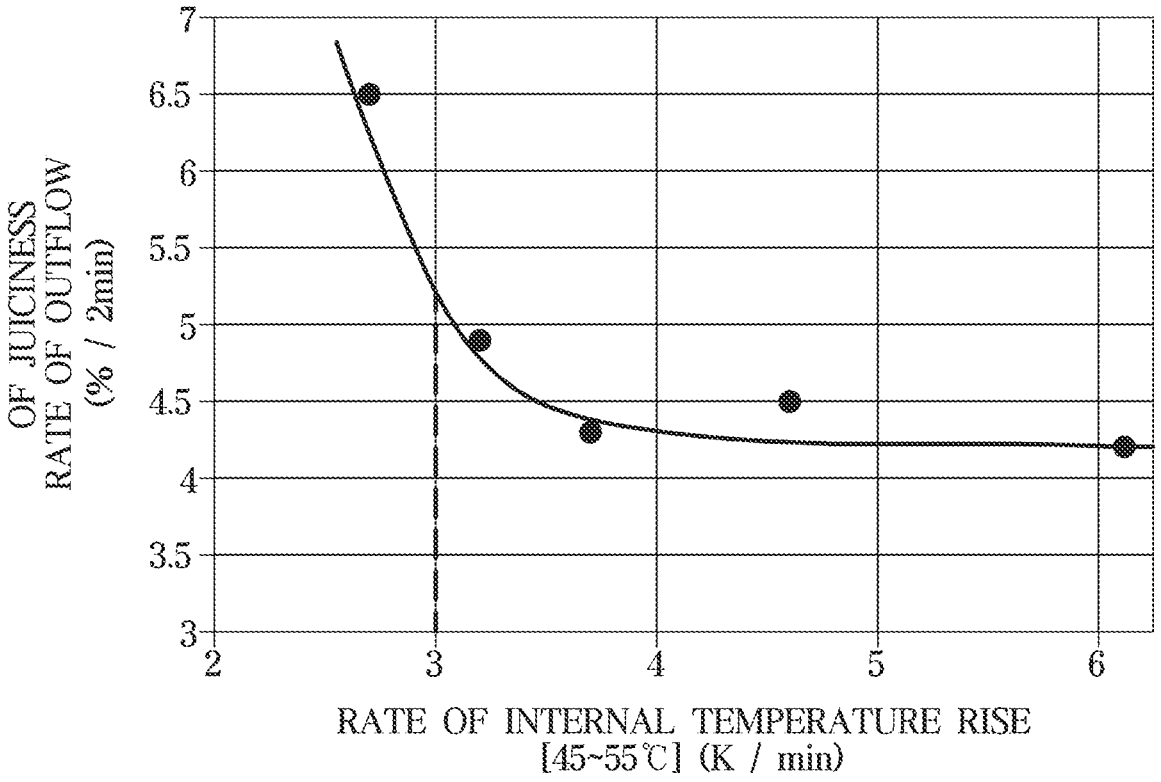
FIG. 7 is a graph illustrating a relationship between a rate of internal temperature rise of a food ingredient in a condition in which the internal temperature of the food ingredient is in a range of from 45° C. to 55° C., and a rate of outflow of juiciness for two minutes after cooking according to an embodiment of the disclosure.
Figure 8:
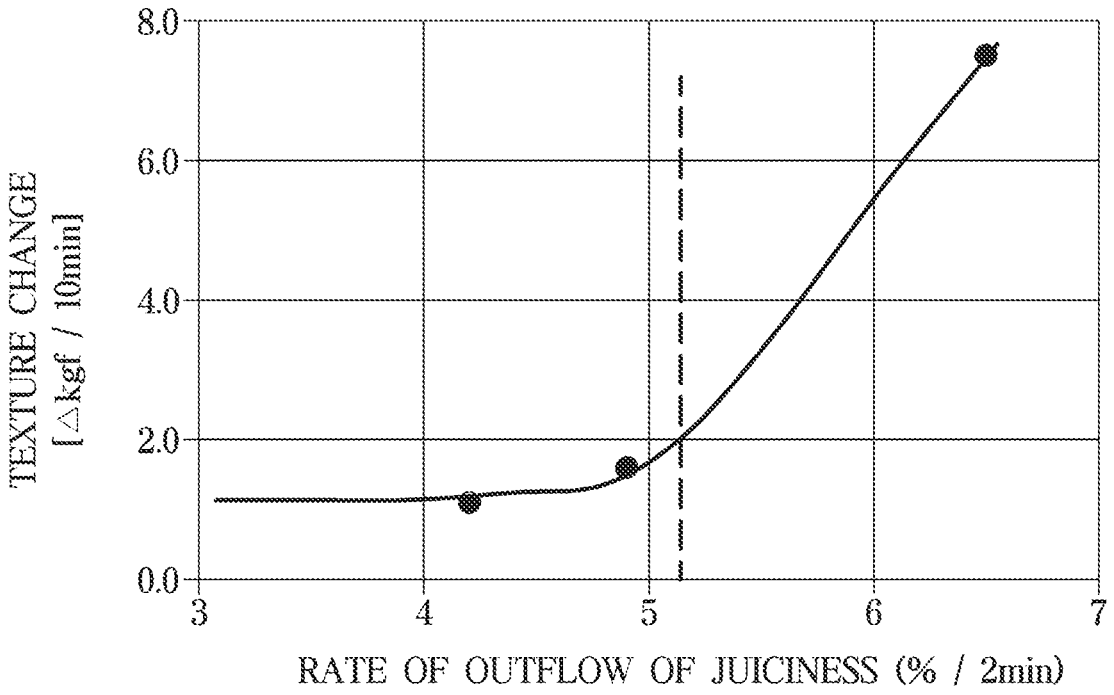
FIG. 8 is a graph illustrating a relationship between a rate of outflow of juiciness for two minutes after cooking and a change in texture for ten minutes after cooking according to an embodiment of the disclosure.

FIG. 7 is a graph illustrating a relationship between a rate of internal temperature rise of a food ingredient in a condition in which the internal temperature of the food ingredient is in a range of from 45° C. to 55° C., and a rate of outflow of juiciness for two minutes after cooking according to an embodiment of the disclosure, and FIG. 8 is a graph illustrating a relationship between a rate of outflow of juiciness for two minutes after cooking and a change in texture for ten minutes after cooking according to an embodiment of the disclosure.

Referring to FIG. 7, by allowing the rate of the internal temperature rise to be 3K/min or more at the internal temperature in the range of from 45° C. to 55° C., it is possible to suppress a rate of outflow of juiciness, which is for two minutes after cooking, to 5% or less.

Referring to FIG. 8, based on a rate of outflow of juiciness for two minutes after cooking that is suppressed to 5% or less, it is possible to suppress an increase in texture for 10 minutes after cooking.

Further, in the embodiment, in a case in which the rate of the internal temperature rise of the food ingredient OB in the low-speed heating cooking operation is less than the rate of the internal temperature rise of the food ingredient OB in the protein denaturation operation because the controller 50 controls the heater 20 to start the protein denaturation operation from the temperature T1 after performing the low-speed heating cooking operation, in which the internal temperature of the food ingredient OB is increased to the temperature T1 that is 45° C. or less, it is possible to make the food ingredient OB, for example, the meat, more tender by suppressing muscle contraction in the meat. In this case, based on the operation completion condition of the finish cooking operation being satisfied at the time of the termination of the protein denaturation operation, the controller 50 may terminate the heating performed by the heater 20. Alternatively, based on the thickness of the food ingredient OB being lcm or less, the controller 50 may control the heater 20 to omit the low-speed heating cooking operation and start the protein denaturation operation.

Further, in the embodiment, in a case in which the controller 50 controls the heater 20 to perform the finish cooking operation, in which the internal temperature of the food ingredient OB is increased from the temperature T2, after performing the protein denaturation operation to the temperature T2 that is 55° C. or more, it is possible to appropriately manage the surface temperature and the internal temperature of the food ingredient OB. In this case, the rate of the internal temperature rise of the food ingredient OB in the finish cooking operation may be greater than the rate of the internal temperature rise of the food ingredient OB in the protein denaturation operation. In addition, a color detector configured to detect a roasted color of a surface of the food ingredient OB may further be provided, and in the finish cooking operation, the controller 50 may control the heater 20 based on the roasted color of the surface of the food ingredient OB detected by the color detector. The color detector may detect a roasted color of a surface of the food ingredient OB by imaging the surface of the food ingredient OB, or alternatively, the color detector may measure a surface temperature of the food ingredient OB and then estimate a roasted color of a surface of the food ingredient OB based on the measured surface temperature of the food ingredient OB.

In the above embodiment, the case in which the temperature detector 31 measures the surface temperature of the food ingredient OB in a non-contact manner has been described as an example, but the temperature detector 31 may be implemented to measure the surface temperature and the internal temperature of the food ingredient OB. For example, the temperature detector 31 may include a probe configured to detect a surface temperature of a food ingredient OB by being inserted into a surface portion of the food ingredient OB and a probe configured to detect an internal temperature of a food ingredient OB by being inserted into an inside of the food ingredient OB. The detection result of the temperature detector 31 (the surface temperature and internal temperature of the food ingredient OB measured by the temperature detector 31) may be transmitted to the controller 50. The controller 50 may obtain the surface temperature and the internal temperature of the food ingredient OB by receiving the detection result of the temperature detector 31.

In the above embodiment, the case in which the heater 20 (particularly, the first heater 21, the second heater 22 and the third heater 23 included in the heater 20) is provided with a heating wire, an infrared heater, or a convention heater has been described as an example, but the heater 20 may be implemented as a high-frequency heating device configured to heat a food ingredient OB by irradiating a high frequency, such as, microwave to the food ingredient OB.

In the above embodiment, the case in which the heater 20 includes the plurality of heaters (particularly, the first heater 21, the second heater 22, and the third heater 23) has been described as an example, but the heater 20 may be provided with one heater.

Further, a type designation manipulation, which is a manipulation for designating the type of food material that is the food ingredient OB, may be given to the manipulator 42. In this case, the controller 50 may identify the type of the food ingredient placed in the heating chamber S based on the type designation manipulation given to the manipulator 42. Similarly, a size designation manipulation, which is a manipulation for designating the size of food material that is the food ingredient OB, may be given to the manipulator 42. In this case, the controller 50 may identify the size of the food ingredient placed in the heating chamber S based on the size designation manipulation given to the manipulator 42.

In addition, in the above embodiment, the case, in which the heating cooking model, which is set for each combination of the type and size of the food ingredient OB, is stored in the storage 41, has been described as an example, but a heating cooking model, which is set for each combination of the type, size and location of the food ingredient OB, may be stored in the storage 41. A location of the food ingredient OB is a position of the food ingredient OB in the heating chamber S. When the three-dimensional information derived by the three-dimensional measurement portion 32 includes the location (coordinate) of the food ingredient OB in the heating chamber S, the location of the food ingredient OB may be calculated from the three-dimensional information. In a case in which the heating cooking model set for each combination of the type, size, and location of the food ingredient OB is stored in the storage 41, the operation switching condition indicated in the heating cooking model is set to a condition suitable for at least one of type, size and location of the food ingredient OB corresponding to the heating cooking model. It is applied to other conditions indicated in the heating cooking model (the operation completion condition or the operation condition of the low-speed heating cooking operation or the operation condition of the protein denaturation operation). For example, a heating contribution of the heater 20 toward the food ingredient OB may be calculated for each location of the food ingredient OB, based on a distance from each heater of the heater 20 to the food ingredient OB, and then the output of the heater 20 may be determined according to the heating contribution. Particularly, in a case, in which the plurality of loading shelves 13 is installed in the up and down direction in the heating chamber S, the output of the heater 20 may be determined according to the location of the food ingredient OB to allow the output of the second heater 22 to be reduced as a location of the food ingredient OB is close to the second heater 22 provided in the upper portion of the heating chamber S.

As described above, the controller 50 may also set the above-mentioned various conditions (for example, operation switching conditions or operation completion conditions) in accordance with at least one of the type, size, and location of the food ingredient OB. Further, the controller 50 may also set the above-mentioned various operation conditions (for example, the output of the heater 20 in the low-speed heating cooking operation or in the protein denaturation operation) in accordance with at least one of the type, size, and location of the food ingredient OB.

In addition, in the above embodiment, the case, in which the operation completion conditions are the condition that the surface temperature of the food ingredient OB reaches the predetermined target surface temperature and the condition that the internal temperature of the food ingredient OB reaches the predetermined target internal temperature, has been described as an example. However, the operation completion condition may be the condition that the surface temperature of the food ingredient OB reaches the predetermined target surface temperature or the condition that the internal temperature of the food ingredient OB reaches the predetermined target internal temperature. With the operation completion condition that the internal temperature of the food ingredient OB reaches the target internal temperature, the termination of the finish cooking operation may be appropriately performed based on the internal temperature of the food ingredient OB. Further, with the operation completion condition that the surface temperature of the food ingredient OB reaches the target surface temperature, the termination of the finish cooking operation may be appropriately performed based on the surface temperature of the food ingredient OB.

As is apparent from the above description, the heating cooker and the heating cooking method may bring out flavor of food ingredients without complicating a user's work.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A heating cooker comprising:

a main body comprising a heating chamber in which a food ingredient is disposed;

a heater configured to heat an inside of the heating chamber;

a temperature detector configured to detect an internal temperature of the food ingredient; and at least one processor configured to:

control the heater to perform a low-speed heating cooking operation, in which the internal temperature of the food ingredient is increased to a first reference temperature by setting a rate of internal temperature rise of the food ingredient equal to or less than a first reference rate;

control the heater to perform a protein denaturation operation, in which the internal temperature of the food ingredient is increased to a temperature in a range from the first reference temperature to a second reference temperature by setting the rate of internal temperature rise of the food ingredient equal to or greater than a second reference rate which is greater than the first reference rate; and based on a thickness of the food ingredient being equal to or less than a reference thickness, control the heater to omit the low-speed heating cooking operation, and start the protein denaturation operation.

2. The heating cooker of claim 1, wherein the at least one processor is further configured to terminate heating performed by the heater upon terminating the protein denaturation operation.

3. The heating cooker of claim 1, wherein the at least one processor is further configured to control the heater to:

start a finish cooking operation, in which the internal temperature of the food ingredient is increased after the second reference temperature is reached, after performing the protein denaturation operation until the second reference temperature is reached.

4. The heating cooker of claim 3, further comprising:

a color detector configured to detect a color of a surface of the food ingredient, wherein in the finish cooking operation, the at least one processor is further configured to control the heater based on the color of the surface of the food ingredient detected by the color detector.

5. The heating cooker of claim 4, wherein the color detector is further configured to detect a roasted color of the surface of the food ingredient by imaging the surface of the food ingredient.

6. The heating cooker of claim 4, wherein the color detector is further configured to:

measure a surface temperature of the food ingredient, and estimate a roasted color of the surface of the food ingredient based on the measured surface temperature of the food ingredient.

7. The heating cooker of claim 1, wherein the temperature detector is further configured to directly detect the internal temperature of the food ingredient.

8. The heating cooker of claim 1, wherein the temperature detector is further configured to:

measure a surface temperature of the food ingredient, and estimate the internal temperature of the food ingredient based on the measured surface temperature of the food ingredient.

9. The heating cooker of claim 1, further comprising:

a color detector configured to detect a color of a surface of the food ingredient, wherein the temperature detector is further configured to estimate the internal temperature of the food ingredient based on the color of the surface of the food ingredient detected by the color detector.

10. The heating cooker of claim 1, wherein the temperature detector is further configured to detect the internal temperature in at least two parts of the food ingredient, and wherein the at least one processor is further configured to control the heater based on a lowest temperature detected by the temperature detector among the at least two parts of the food ingredient.

11. The heating cooker of claim 1, wherein the temperature detector is further configured to detect a temperature of a region within 1 cm from a surface of the food ingredient based on a thickness of the food ingredient being 3 cm or more.

12. The heating cooker of claim 1, further comprising:

a humidifier configured to generate and supply steam to the inside of the heating chamber, wherein the at least one processor is further configured to control the heater according to a cooking state of the food ingredient.

13. The heating cooker of claim 1, wherein the first reference temperature is equal to or less than 45° C., and wherein the second reference temperature is equal to or greater than 55° C.

14. The heating cooker of claim 1, wherein the second reference rate is 3K/min.

15. A method of using a heating cooker comprising a main body including a heating chamber in which a food ingredient is disposed, a heater configured to heat an inside of the heating chamber, and a temperature detector configured to detect an internal temperature of the food ingredient, the method comprising:

detecting the internal temperature of the food ingredient by the temperature detector; and controlling the heater based on the internal temperature of the food ingredient detected by the temperature detector, wherein the controlling of the heater comprises:

performing a low-speed heating cooking operation, in which the internal temperature of the food ingredient is increased to a first reference temperature by setting a rate of internal temperature rise of the food ingredient equal to or less than a first reference rate;

performing a protein denaturation operation, in which the internal temperature of the food ingredient is increased to a temperature in a range from the first reference temperature to a second reference temperature by setting the rate of internal temperature rise of the food ingredient equal to or greater than a second reference rate which is greater than the first reference rate; and based on a thickness of the food ingredient being equal to or less than a reference thickness, omitting the low-speed heating cooking operation, and starting the protein denaturation operation.

16. The method of claim 15, wherein the controlling of the heater comprises:

controlling the heater to start a finish cooking operation, in which the internal temperature of the food ingredient is increased after the second reference temperature is reached, after performing the protein denaturation operation until the second reference temperature is reached.

17. The method of claim 15, wherein the food ingredient includes meat, wherein the first reference temperature is equal to or less than 45° C., wherein the second reference temperature is equal to or greater than 55° C., and wherein the second reference rate is 3K/min.

18. The method of claim 15, wherein the controlling of the heater comprises:

in response to a thickness of the food ingredient being 3 cm or more, detecting a temperature of a region within 1 cm from a surface of the food ingredient as the internal temperature of the food ingredient.

* * * * *